US009928787B2

(12) United States Patent
Wang et al.

(10) Patent No.: US 9,928,787 B2
(45) Date of Patent: Mar. 27, 2018

(54) LIQUID CRYSTAL DISPLAY DEVICE

(71) Applicant: WUHAN CHINA STAR OPTOELECTRONICS TECHNOLOGY CO., LTD., Wuhan, Hubei (CN)

(72) Inventors: Cong Wang, Hubei (CN); Peng Du, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 55 days.

(21) Appl. No.: 14/907,543

(22) PCT Filed: Jan. 6, 2016

(86) PCT No.: PCT/CN2016/070285
§ 371 (c)(1),
(2) Date: Jan. 25, 2016

(87) PCT Pub. No.: WO2017/101176
PCT Pub. Date: Jun. 22, 2017

(65) Prior Publication Data

US 2017/0323606 A1 Nov. 9, 2017

(30) Foreign Application Priority Data

Dec. 15, 2015 (CN) ..... 2015 1 0934398

(51) Int. Cl.
*G09G 3/36* (2006.01)

(52) U.S. Cl.
CPC ..... *G09G 3/3614* (2013.01); *G09G 3/3607* (2013.01); *G09G 3/3685* (2013.01);
(Continued)

(58) Field of Classification Search
CPC ..... G02F 1/1345; G02F 1/136286; G02F 2001/13629
See application file for complete search history.

(56) References Cited

U.S. PATENT DOCUMENTS

2006/0119557 A1 6/2006 Sano et al.
2008/0001892 A1* 1/2008 Kim ..... G02F 1/1345 345/97

(Continued)

FOREIGN PATENT DOCUMENTS

CN 1819005 A 8/2006
CN 104867468 A 8/2015

(Continued)

*Primary Examiner* — Shaheda Abdin
(74) *Attorney, Agent, or Firm* — Kirton McConkie; Evan R. Witt

(57) ABSTRACT

A liquid crystal display device includes a liquid crystal panel; at least one source driving unit including at least one first fan-out line and at least one second fan-out line which are disposed alternately; at least one demultiplexer electrically coupled to the first fan-out line and the second fan-out line, the demultiplexer including a plurality of buses, a plurality of first output lines, and a plurality of second output lines; and a plurality of pixel units, each of the pixel units including four sub-pixels. The liquid crystal display device is capable of solving the flicker problem and the crosstalk problem in the prior art.

18 Claims, 5 Drawing Sheets

(52) U.S. Cl.
CPC ..... *G09G 2300/0426* (2013.01); *G09G 2300/0452* (2013.01); *G09G 2310/0227* (2013.01); *G09G 2310/0297* (2013.01); *G09G 2320/0209* (2013.01); *G09G 2320/0247* (2013.01)

(56) References Cited

U.S. PATENT DOCUMENTS

| | | | | |
|---|---|---|---|---|
| 2008/0224982 | A1* | 9/2008 | Yamazaki | G09G 3/3688 345/98 |
| 2009/0146938 | A1 | 6/2009 | Takada et al. | |
| 2011/0164076 | A1* | 7/2011 | Lee | G09G 3/3406 345/691 |
| 2011/0299023 | A1 | 12/2011 | Lee | |
| 2014/0184583 | A1 | 7/2014 | Wyatt | |
| 2017/0032749 | A1 | 2/2017 | Liu et al. | |

FOREIGN PATENT DOCUMENTS

| | | | |
|---|---|---|---|
| CN | 105093737 | A | 11/2015 |
| JP | 2009139774 | A | 6/2009 |
| JP | 2010122692 | A | 6/2010 |

* cited by examiner

| | | | | | | | |
|---|---|---|---|---|---|---|---|
| + | - | | | - | + | | |
| | | - | + | | | + | - |
| + | - | | | - | + | | |
| | | - | + | | | + | - |

FIG. 4

| | | | | | | | |
|---|---|---|---|---|---|---|---|
| | | + | - | | | - | + |
| - | + | | | + | - | | |
| | | + | - | | | - | + |
| - | + | | | + | - | | |

FIG. 5

| | | | | | | | |
|---|---|---|---|---|---|---|---|
| + | - | + | - | - | + | - | + |
| - | + | - | + | + | - | + | - |
| + | - | + | - | - | + | - | + |
| - | + | - | + | + | - | + | - |

FIG. 6

| | | | | | | | |
|---|---|---|---|---|---|---|---|
| + | | - | | - | | + | |
| | - | | + | | + | | - |
| + | | - | | - | | + | |
| | - | | + | | + | | - |

FIG. 8

| | | | | | | | |
|---|---|---|---|---|---|---|---|
| | + | | - | | - | | + |
| - | | + | | + | | - | |
| | + | | - | | - | | + |
| - | | + | | + | | - | |

FIG. 9

| | | | | | | | |
|---|---|---|---|---|---|---|---|
| + | + | - | - | - | - | + | + |
| - | - | + | + | + | + | - | - |
| + | + | - | - | - | - | + | + |
| - | - | + | + | + | + | - | - |

FIG. 10

LIQUID CRYSTAL DISPLAY DEVICE

BACKGROUND OF THE INVENTION

1. Field of the Invention

The present invention generally relates to a display device, and more particularly to a liquid crystal display device.

2. Description of Prior Art

In order to reduce a pin number of source integrated circuits in a conventional liquid crystal display device comprising RGBW (red-green-blue-white) pixels, a demultiplexer (DE-Mux) is utilized for dividing a fan-out line of a source integrated circuit into a plurality of output lines. Then, the demultiplexer controls the each of the output lines to be turned on or off. Finally, data is written to pixels in a display area via data lines according to turned-on and turned-off states of each of the output lines and turned-on and turned-off states of scan lines.

However, in the above-mentioned control manner, the output lines corresponding to the same fan-out line are driven by the same voltage polarity. A frame inversion mode is implemented during polarity inversions of liquid crystals, and thus a flicker problem occurs. For the RGBW pixels, a fan-out line is divided into four output lines, crosstalk phenomenon occurs, and the performance of the conventional liquid crystal display device is affected.

Consequently, there is a need to solve the above-mentioned problems in the prior art.

SUMMARY OF THE INVENTION

An objective of the present invention is to provide a liquid crystal display device capable of solving the flicker problem and the crosstalk problem in the prior art.

To solve the above-mentioned problems, a liquid crystal display device provided by the present invention comprises: a liquid crystal panel; at least one source driving unit disposed on the liquid crystal panel and comprising at least one first fan-out line and at least one second fan-out line which are disposed alternately; at least one demultiplexer disposed on the liquid crystal panel and electrically coupled to the first fan-out line and the second fan-out line, the demultiplexer comprising a plurality of buses, a plurality of first output lines, and a plurality of second output lines, the first output lines and the second output lines alternately disposed, each of the buses electrically coupled to one of the first output lines and one of the second output lines; and a plurality of pixel units, each of the pixel units comprising four sub-pixels, in the four sub-pixels of each of the pixel units in an N column, a first and a fourth of the sub-pixels respectively and electrically coupled to a first and a fourth of the first output lines, and a second and a third of the sub-pixels respectively and electrically coupled to a second and a third of the second output lines, in the four sub-pixels of each of the pixel units in an N+1 column, a first and a fourth of the sub-pixels respectively and electrically coupled to a first and a fourth of the second output lines, a second and a third of the sub-pixels respectively and electrically coupled to a second and a third of the first output lines, and N is an odd number greater than or equal to 1.

In the liquid crystal display device of the present invention, the first polarity signal and the second polarity signal have opposite polarities.

In the liquid crystal display device of the present invention, frames are made in sets of four, the first polarity signal has the same polarity in a first and fourth frames in each of the sets, and the first polarity signal has the same polarity in a second and a third frames in each of the sets.

In the liquid crystal display device of the present invention, the frames are made in sets of four, the second polarity signal has the same polarity in the first and fourth frames in each of the sets, and the second polarity signal has the same polarity in the second and third frames in each of the sets.

In the liquid crystal display device of the present invention, each of the buses is utilized for controlling the first polarity signal and the second polarity signal to be outputted to one of the first output lines and one of the second output lines.

The liquid crystal display device of the present invention further comprises a plurality of scan lines and four buses. The scan lines are electrically coupled to the pixel units. In odd numbers of frames, when odd numbers of the scan lines are turned on, a first and a second of the buses are sequentially enabled. When even numbers of the scan lines are turned on, a third and a fourth of the buses are sequentially enabled.

In the liquid crystal display device of the present invention, in even numbers of the frames, when the odd numbers of the scan lines are turned on, the third and the fourth of the buses are sequentially enabled. When the even numbers of the scan lines are turned on, the first and the second of the buses are sequentially enabled.

The liquid crystal display device of the present invention further comprises a plurality of scan lines and four buses. The scan lines are electrically coupled to the pixel units. In odd numbers of frames, when odd numbers of the scan lines are turned on, a first and a third of the buses are sequentially enabled. When even numbers of the scan lines are turned on, a second and a fourth of the buses are sequentially enabled.

In the liquid crystal display device of the present invention, in even numbers of the frames, when the odd numbers of the scan lines are turned on, the second and the fourth of the buses are sequentially enabled. When the even numbers of the scan lines are turned on, the first and the third of the buses are sequentially enabled.

In the liquid crystal display device of the present invention, the four sub-pixels comprise a red sub-pixel, a green sub-pixel, a blue sub-pixel, and a white sub-pixel.

To solve the above-mentioned problems, a liquid crystal display device provided by the present invention comprises: a liquid crystal panel; at least one source driving unit disposed on the liquid crystal panel and comprising at least one first fan-out line and at least one second fan-out line; at least one demultiplexer disposed on the liquid crystal panel and electrically coupled to the first fan-out line and the second fan-out line, the demultiplexer comprising a plurality of buses, a plurality of first output lines, and a plurality of second output lines, each of the buses electrically coupled to one of the first output lines and one of the second output lines; and a plurality of pixel units, each of the pixel units comprising four sub-pixels, in the four sub-pixels of each of the pixel units in an N column, a first and a fourth of the sub-pixels respectively and electrically coupled to a first and a fourth of the first output lines, and a second and a third of the sub-pixels respectively and electrically coupled to a second and a third of the second output lines, in the four sub-pixels of each of the pixel units in an N+1 column, a first and a fourth of the sub-pixels respectively and electrically coupled to a first and a fourth of the second output lines, a second and a third of the sub-pixels respectively and electrically coupled to a second and a third of the first output lines, and N is an odd number greater than or equal to 1.

In the liquid crystal display device of the present invention, the first polarity signal and the second polarity signal have opposite polarities.

In the liquid crystal display device of the present invention, frames are made in sets of four, the first polarity signal has the same polarity in a first and fourth frames in each of the sets, and the first polarity signal has the same polarity in a second and a third frames in each of the sets.

In the liquid crystal display device of the present invention, the frames are made in sets of four, the second polarity signal has the same polarity in the first and fourth frames in each of the sets, and the second polarity signal has the same polarity in the second and third frames in each of the sets.

In the liquid crystal display device of the present invention, each of the buses is utilized for controlling the first polarity signal and the second polarity signal to be outputted to one of the first output lines and one of the second output lines.

The liquid crystal display device of the present invention further comprises a plurality of scan lines and four buses. The scan lines are electrically coupled to the pixel units. In odd numbers of frames, when odd numbers of the scan lines are turned on, a first and a second of the buses are sequentially enabled. When even numbers of the scan lines are turned on, a third and a fourth of the buses are sequentially enabled.

In the liquid crystal display device of the present invention, in even numbers of the frames, when the odd numbers of the scan lines are turned on, the third and the fourth of the buses are sequentially enabled. When the even numbers of the scan lines are turned on, the first and the second of the buses are sequentially enabled.

The liquid crystal display device of the present invention further comprises a plurality of scan lines and four buses. The scan lines are electrically coupled to the pixel units. In odd numbers of frames, when odd numbers of the scan lines are turned on, a first and a third of the buses are sequentially enabled. When even numbers of the scan lines are turned on, a second and a fourth of the buses are sequentially enabled.

In the liquid crystal display device of the present invention, in even numbers of the frames, when the odd numbers of the scan lines are turned on, the second and the fourth of the buses are sequentially enabled. When the even numbers of the scan lines are turned on, the first and the third of the buses are sequentially enabled.

In the liquid crystal display device of the present invention, the four sub-pixels comprise a red sub-pixel, a green sub-pixel, a blue sub-pixel, and a white sub-pixel.

Comparing with the prior art, the liquid crystal display device of the present invention can solve the flicker problem and the crosstalk problem in the prior art. Furthermore, comparing with the prior art in which a dot inversion mode is implemented, the present invention has the advantage of consuming less power.

For a better understanding of the aforementioned content of the present invention, preferable embodiments are illustrated in accordance with the attached figures for further explanation.

BRIEF DESCRIPTION OF THE DRAWINGS

FIG. 4 shows driving polarities of pixel units in a frame 1;

FIG. 5 shows driving polarities of the pixel units in a frame 2;

FIG. 6 shows the driving polarities when the driving polarities in FIG. 4 and the driving polarities in FIG. 5 are added;

FIG. 8 shows driving polarities of the pixel units in a frame 1;

FIG. 9 shows driving polarities of the pixel units in a frame 2; and

FIG. 10 shows the driving polarities when the driving polarities in FIG. 8 and the driving polarities in FIG. 9 are added.

DETAILED DESCRIPTION OF THE INVENTION

The following embodiments are referring to the accompanying drawings for exemplifying specific implementable embodiments of the present invention.

Figure 1:
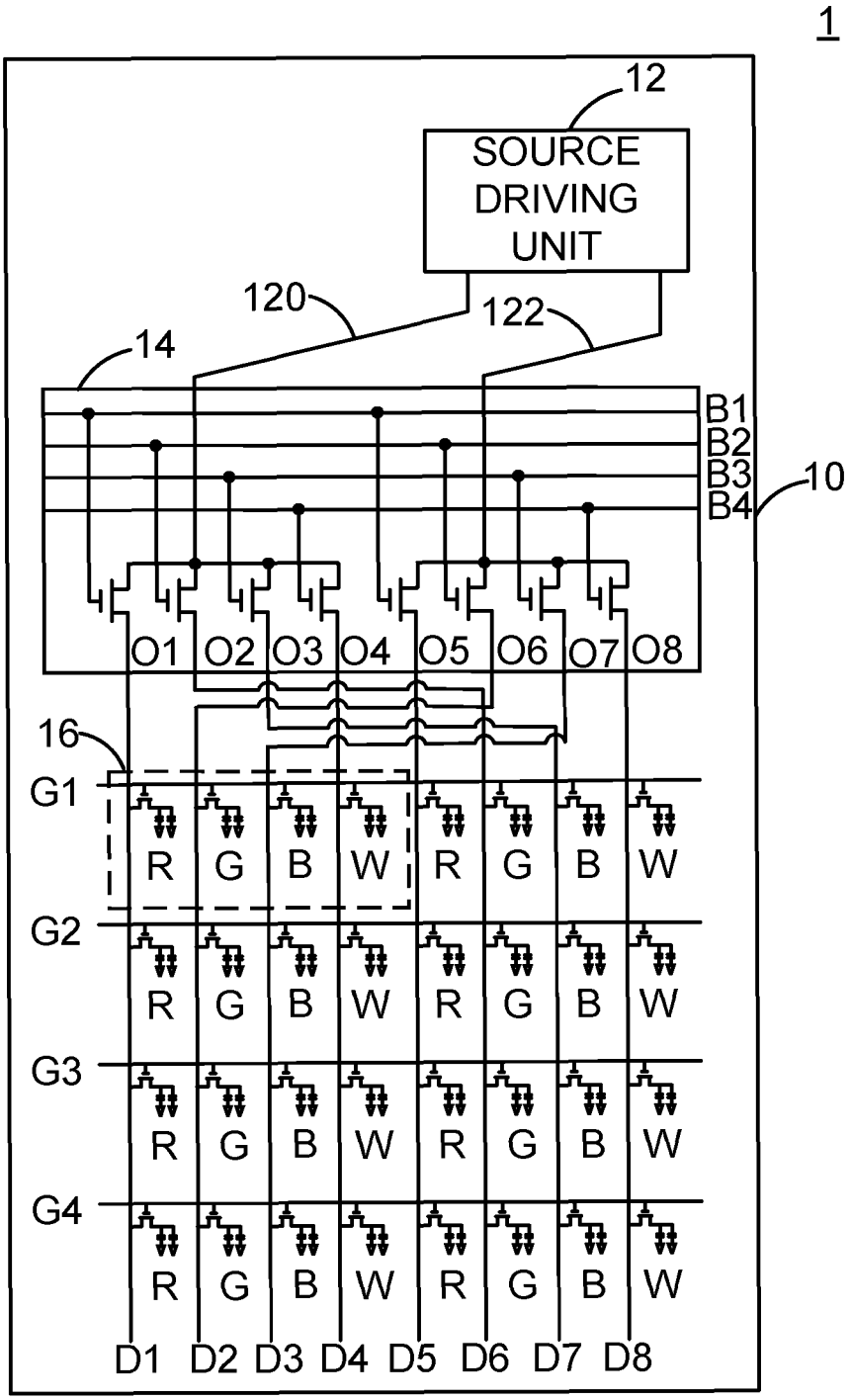
FIG. 1 shows a liquid crystal display device in accordance with an embodiment of the present invention.

Please refer to FIG. 1. FIG. 1 shows a liquid crystal display device 1 in accordance with an embodiment of the present invention.

The liquid crystal display device 1 comprises a liquid crystal panel 10, at least one source driving unit 12 (a source driving unit 12 is shown in FIG. 1), at least one demultiplexer 14 (a demultiplexer 14 is shown in FIG. 1), a plurality of pixel units 16, a plurality of scan lines G1-G4, and a plurality of data lines D1-D8.

The source driving unit 12 is disposed on the liquid crystal panel 10 and comprising at least one first fan-out line 120 and at least one second fan-out line 122 (a first fan-out line 120 and a second fan-out line 122 are shown in FIG. 1) which are disposed alternately. The first fan-out line 120 is utilized for outputting a first polarity signal, and the second fan-out line 122 is utilized for outputting a second polarity signal. The first polarity signal and the second polarity signal have opposite polarities. When the first polarity signal is one of a positive polarity signal and a negative polarity signal, the second polarity signal is the other one of the positive polarity signal and the negative polarity signal. The positive polarity signal represents that a voltage thereof is greater than a common voltage (Vcom), and the negative polarity signal represents that a voltage thereof is less than the common voltage.

The demultiplexer 14 is disposed on the liquid crystal panel 10 and electrically coupled to the first fan-out line 120 and the second fan-out line 122. The demultiplexer 14 comprises a plurality of buses B1-B4, a plurality of first output lines O1-O4, and a plurality of second output lines O5-O8. The first output lines O1-O4 and the second output lines O5-O8 are alternately disposed. Each of the buses B1-B4 is electrically coupled to one of the first output lines O1-O4 and one of the second output lines O5-O8. Specifically, the bus B1 is electrically coupled to the first output line O1 and the second output line O5. The bus B2 is electrically coupled to the first output line O2 and the second output line O6. The bus B3 is electrically coupled to the first output line O3 and the second output line O7. The bus B4 is electrically coupled to the first output line O4 and the second output line O8. Each of the buses B1-B4 is utilized for controlling the first polarity signal and the second polarity signal to be outputted to one of the first output lines O1-O4 and one of the second output lines O5-O8.

For example, when the bus B1 is enabled, the first polarity signal which is outputted by the first fan-out line 120 is outputted to the first output line O1 and the second output line O5. When the bus B2 is enabled, the first polarity signal which is outputted by the first fan-out line 120 is outputted to the first output line O2 and the second output line O6.

Each of the pixel units 16 comprises a plurality of sub-pixels. In the present embodiment, each of the pixel units 16 comprises four sub-pixels. The four sub-pixels comprise a red sub-pixel R, a green sub-pixel G, a blue sub-pixel B, and a white sub-pixel W. It is noted that a sequence of the red sub-pixel R, the green sub-pixel G, the blue sub-pixel B, and the white sub-pixel W is not limited to that shown is FIG. 1.

In the four sub-pixels of each of the pixel units 16 in a first column (i.e. corresponding to the data lines D1-D4), the first sub-pixels (the red sub-pixels R) and the fourth sub-pixels (the white sub-pixels W) are respectively and electrically coupled to the first one (O1) of the first output lines O1-O4 and the fourth one (O4) of the first output lines O1-O4, and the second sub-pixels (the green sub-pixels G) and the third sub-pixels (the blue sub-pixels B) are respectively and electrically coupled to the second one (O6) of the second output lines O5-O8 and the third one (O7) of the second output lines O5-O8.

In the four sub-pixels of each of the pixel units 16 in a second column (i.e. corresponding to the data lines D5-D8), the first sub-pixels (the red sub-pixels R) and the fourth sub-pixels (the white sub-pixels W) are respectively and electrically coupled to the first one (O5) of the second output lines O5-O8 and the fourth one (O8) of the second output lines O5-O8, and the second sub-pixels (the green sub-pixels G) and the third sub-pixels (the blue sub-pixels B) are respectively and electrically coupled to the second one (O2) of the first output lines O1-O4 and the third one (O3) of the first output lines O1-O4.

In summary, in the four sub-pixels of each of the pixel units 16 in an N column (an odd number of column), the first sub-pixels (the red sub-pixels R) and the fourth sub-pixels (the white sub-pixels W) are respectively and electrically coupled to the first one (O1) of the first output lines O1-O4 and the fourth one (O4) of the first output lines O1-O4, and the second sub-pixels (the green sub-pixels G) and the third sub-pixels (the blue sub-pixels B) are respectively and electrically coupled to the second one (O6) of the second output lines O5-O8 and the third one (O7) of the second output lines O5-O8. In the four sub-pixels of each of the pixel units 16 in an N+1 (an even number of column) column, the first sub-pixels (the red sub-pixels R) and the fourth sub-pixels (the white sub-pixels W) are respectively and electrically coupled to the first one (O5) of the second output lines O5-O8 and the fourth one (O8) of the second output lines O5-O8, and the second sub-pixels (the green sub-pixels G) and the third sub-pixels (the blue sub-pixels B) are respectively and electrically coupled to the second one (O2) of the first output lines O1-O4 and the third one (O3) of the first output lines O1-O4. N is an odd number greater than or equal to 1.

The scan lines G1-G4 are electrically coupled to the pixel units 16. When the scan lines G1-G4 are sequentially turned on, the first polarity signal which is outputted by the first fan-out line 120 is written to the corresponding one of pixel units 16 via the corresponding one of the data lines D1-D4, and the second polarity signal which is outputted by the second fan-out line 122 is written to the corresponding one of the pixel units 16 via the corresponding one of the data lines D5-D8.

Figure 2:
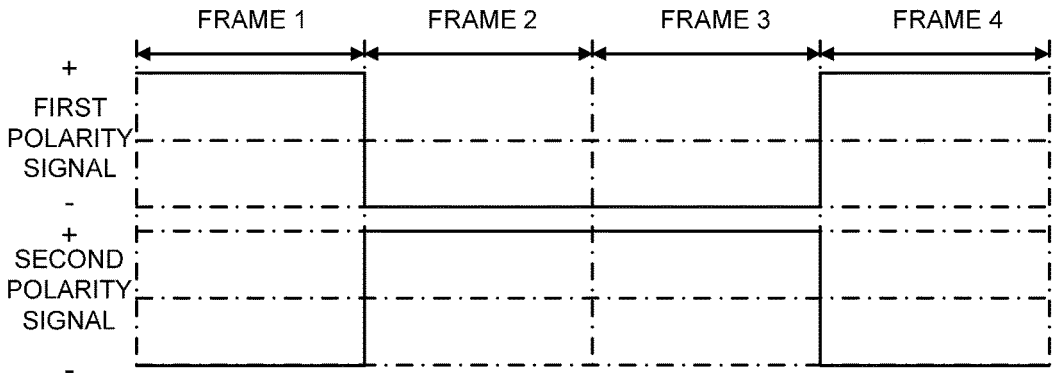
FIG. 2 shows waveforms of a first polarity signal which is outputted by a first fan-out line and a second polarity signal which is outputted by a second fan-out line.
Figure 3:
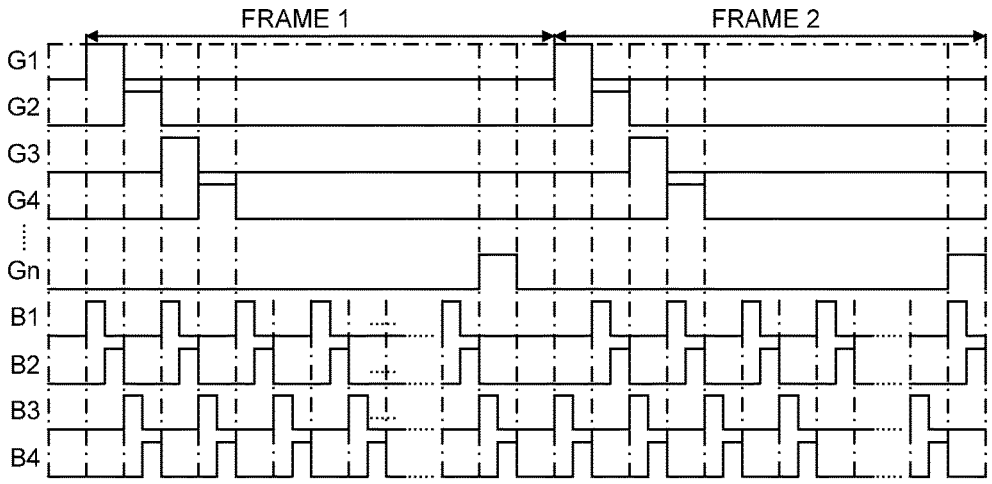
FIG. 3 shows a driving timing diagram in accordance with a first embodiment of the present invention.

Please refer to FIGS. 1-6. FIG. 2 shows waveforms of the first polarity signal which is outputted by the first fan-out line 120 and the second polarity signal which is outputted by the second fan-out line 122. FIG. 3 shows a driving timing diagram in accordance with a first embodiment of the present invention. FIG. 4 shows driving polarities of the pixel units 16 in a frame 1. FIG. 5 shows driving polarities of the pixel units 16 in a frame 2. FIG. 6 shows the driving polarities when the driving polarities in FIG. 4 and the driving polarities in FIG. 5 are added.

As shown in FIG. 2, in the frame 1, the first polarity signal is a positive polarity signal, and the second polarity signal is a negative polarity signal. In the frame 2, the first polarity signal is a negative polarity signal, and the second polarity signal is a positive polarity signal. In the frame 3, the first polarity signal is a negative polarity signal, and the second polarity signal is a positive polarity signal. In the frame 4, the first polarity signal is a positive polarity signal, and the second polarity signal is a negative polarity signal. It can be understood from FIG. 2 that the frames are made in sets of four. The first polarity signal has the same polarity in the first and fourth frames in each of the sets, and the first polarity signal has the same polarity in the second and third frames in each of the sets. The frames are made in sets of four. The second polarity signal has the same polarity in the first and fourth frames in each of the sets, and the second polarity signal has the same polarity in the second and third frames in each of the sets.

As shown in FIG. 3, in the frame 1, the scan lines G1-Gn are sequentially scanned (turned on). When the scan line G1 is turned on, the buses B1-B2 are sequentially enabled. Specifically, the bus B1 is enabled firstly. The first polarity signal which is outputted by the first fan-out line 120 is written to the corresponding one of the pixel units 16 via the first output line O1 and the data line D1, and the second polarity signal which is outputted by the second fan-out line 122 is written to the corresponding one of the pixel units 16 via the second output line O5 and the data line D5.

Then, the bus B1 is disabled, and the bus B2 is enabled. The first polarity signal which is outputted by the first fan-out line 120 is written to the corresponding one of the pixel units 16 via the first output line O2 and the data line D6, and the second polarity signal which is outputted by the second fan-out line 122 is written to the corresponding one of the pixel units 16 via the second output line O6 and the data line D2.

Then, when the scan line G2 is turned on, the buses B3-B4 are sequentially enabled. Specifically, the bus B3 is enabled firstly. The first polarity signal which is outputted by the first fan-out line 120 is written to the corresponding one of the pixel units 16 via the first output line O3 and the data line D7, and the second polarity signal which is outputted by the second fan-out line 122 is written to the corresponding one of the pixel units 16 via the second output line O7 and the data line D3.

Then, the bus B3 is disabled, and the bus B4 is enabled. The first polarity signal which is outputted by the first fan-out line 120 is written to the corresponding one of the pixel units 16 via the first output line O4 and the data line D4, and the second polarity signal which is outputted by the second fan-out line 122 is written to the corresponding one of the pixel units 16 via the second output line O8 and the data line D8.

Then, the scan line G3-Gn are sequentially turned on, and the buses B1-B4 are sequentially enabled and disabled in accordance with the above-mentioned control method. That is, when odd numbers (G1, G3, and so on) of the scan lines are turned on, the buses B1-B2 are enabled. When even numbers (G2, G4, and so on) of the scan lines are turned on, the buses B3-B4 are enabled. The driving polarities of the pixel units 16 in the frame 1 are shown in FIG. 4.

In the frame 2, the scan lines G1-Gn are sequentially scanned (turned on). When the scan line G1 is turned on, the buses B3-B4 are sequentially enabled. Specifically, the bus B3 is enabled firstly. The first polarity signal which is outputted by the first fan-out line 120 is written to the corresponding one of the pixel units 16 via the first output line O3 and the data line D7, and the second polarity signal which is outputted by the second fan-out line 122 is written to the corresponding one of the pixel units 16 via the second output line O7 and the data line D3.

Then, the bus B3 is disabled, and the bus B4 is enabled. The first polarity signal which is outputted by the first fan-out line 120 is written to the corresponding one of the pixel units 16 via the first output line O4 and the data line D4, and the second polarity signal which is outputted by the second fan-out line 122 is written to the corresponding one of the pixel units 16 via the second output line O8 and the data line D8.

Then, when the scan line G2 is turned on, the buses B1-B2 are sequentially enabled. Specifically, the bus B1 is enabled firstly. The first polarity signal which is outputted by the first fan-out line 120 is written to the corresponding one of the pixel units 16 via the first output line O1 and the data line D1, and the second polarity signal which is outputted by the second fan-out line 122 is written to the corresponding one of the pixel units 16 via the second output line O5 and the data line D5.

Then, the bus B1 is disabled, and the bus B2 is enabled. The first polarity signal which is outputted by the first fan-out line 120 is written to the corresponding one of the pixel units 16 via the first output line O2 and the data line D6, and the second polarity signal which is outputted by the second fan-out line 122 is written to the corresponding one of the pixel units 16 via the second output line O6 and the data line D2.

Then, the scan line G3-Gn are sequentially turned on, and the buses B1-B4 are sequentially enabled and disabled in accordance with the above-mentioned control method. That is, when the odd numbers (G1, G3, and so on) of the scan lines are turned on, the buses B3-B4 are enabled. When the even numbers (G2, G4, and so on) of the scan lines are turned on, the buses B1-B2 are enabled. The driving polarities of the pixel units 16 in the frame 2 are shown in FIG. 5.

In summary, in the odd numbers of the frames, when the odd numbers of the scan lines are turned on, the first and the second of the buses are sequentially enabled. When the even numbers of the scan lines are turned on, the third and the fourth of the buses are sequentially enabled. In the even numbers of the frames, when the odd numbers of the scan lines are turned on, the third and the fourth of the buses are sequentially enabled. When the even numbers of the scan lines are turned on, the first and the second of the buses are sequentially enabled.

As shown in FIG. 6, effect similar to a dot inversion mode is produced after the driving polarities of the pixel units 16 in the frame 1 (FIG. 4) and the driving polarities of the pixel units 16 in frame 2 (FIG. 5) are added. As a result, the flicker problem and the crosstalk problem in the prior art can be effectively improved.

Figure 7:
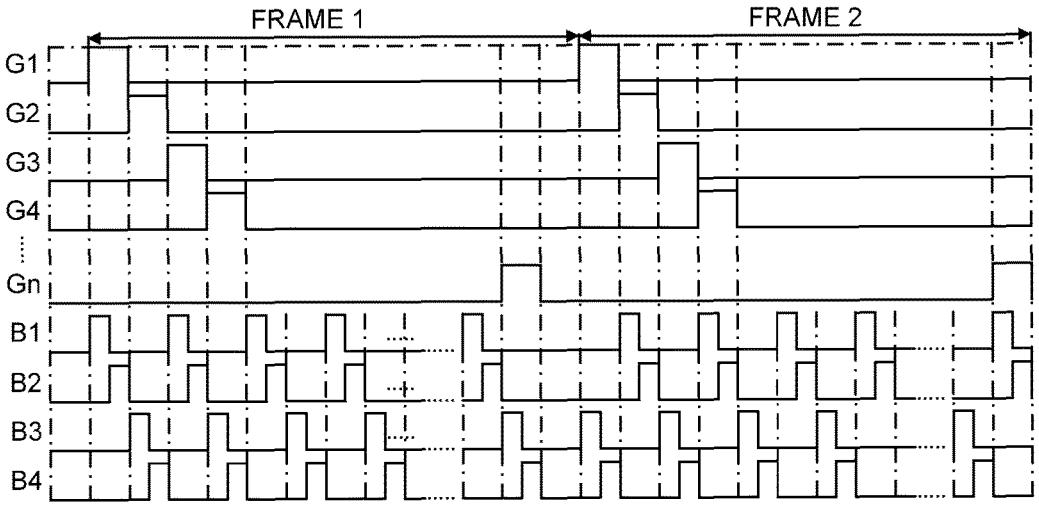
FIG. 7 shows a driving timing diagram in accordance with a second embodiment of the present invention.

Please refer to FIGS. 1-2 and 7-10. FIG. 7 shows a driving timing diagram in accordance with a second embodiment of the present invention. FIG. 8 shows driving polarities of the pixel units 16 in a frame 1. FIG. 9 shows driving polarities of the pixel units 16 in a frame 2. FIG. 10 shows the driving polarities when the driving polarities in FIG. 8 and the driving polarities in FIG. 9 are added.

As shown in FIG. 7, in the frame 1, in the frame 1, the scan lines G1-Gn are sequentially scanned (turned on). When the scan line G1 is turned on, the buses B1 and B3 are sequentially enabled. Specifically, the bus B1 is enabled firstly. The first polarity signal which is outputted by the first fan-out line 120 is written to the corresponding one of the pixel units 16 via the first output line O1 and the data line D1, and the second polarity signal which is outputted by the second fan-out line 122 is written to the corresponding one of the pixel units 16 via the second output line O5 and the data line D5.

Then, the bus B1 is disabled, and the bus B3 is enabled. The first polarity signal which is outputted by the first fan-out line 120 is written to the corresponding one of the pixel units 16 via the first output line O3 and the data line D7, and the second polarity signal which is outputted by the second fan-out line 122 is written to the corresponding one of the pixel units 16 via the second output line O7 and the data line D3.

Then, when the scan line G2 is turned on, the buses B2 and B4 are sequentially enabled. Specifically, the bus B2 is enabled firstly. The first polarity signal which is outputted by the first fan-out line 120 is written to the corresponding one of the pixel units 16 via the first output line O2 and the data line D6, and the second polarity signal which is outputted by the second fan-out line 122 is written to the corresponding one of the pixel units 16 via the second output line O6 and the data line D2.

Then, the bus B2 is disabled, and the bus B4 is enabled. The first polarity signal which is outputted by the first fan-out line 120 is written to the corresponding one of the pixel units 16 via the first output line O4 and the data line D4, and the second polarity signal which is outputted by the second fan-out line 122 is written to the corresponding one of the pixel units 16 via the second output line O8 and the data line D8.

Then, the scan line G3-Gn are sequentially turned on, and the buses B1-B4 are sequentially enabled and disabled in accordance with the above-mentioned control method. That is, when odd numbers (G1, G3, and so on) of the scan lines are turned on, the buses B1 and B3 are enabled. When even numbers (G2, G4, and so on) of the scan lines are turned on, the buses B2 and B4 are enabled. The driving polarities of the pixel units 16 in the frame 1 are shown in FIG. 8.

In the frame 2, the scan lines G1-Gn are sequentially scanned (turned on). When the scan line G1 is turned on, the buses B2 and B4 are sequentially enabled. Specifically, the bus B2 is enabled firstly. The first polarity signal which is outputted by the first fan-out line 120 is written to the corresponding one of the pixel units 16 via the first output line O2 and the data line D6, and the second polarity signal which is outputted by the second fan-out line 122 is written to the corresponding one of the pixel units 16 via the second output line O6 and the data line D2.

Then, the bus B2 is disabled, and the bus B4 is enabled. The first polarity signal which is outputted by the first fan-out line 120 is written to the corresponding one of the pixel units 16 via the first output line O4 and the data line D4, and the second polarity signal which is outputted by the second fan-out line 122 is written to the corresponding one of the pixel units 16 via the second output line O8 and the data line D8.

Then, when the scan line G2 is turned on, the buses B1 and B3 are sequentially enabled. Specifically, the bus B1 is enabled firstly. The first polarity signal which is outputted by the first fan-out line 120 is written to the corresponding one of the pixel units 16 via the first output line O1 and the data line D1, and the second polarity signal which is outputted by the second fan-out line 122 is written to the corresponding one of the pixel units 16 via the second output line O5 and the data line D5.

Then, the bus B1 is disabled, and the bus B3 is enabled. The first polarity signal which is outputted by the first fan-out line 120 is written to the corresponding one of the pixel units 16 via the first output line O3 and the data line D7, and the second polarity signal which is outputted by the second fan-out line 122 is written to the corresponding one of the pixel units 16 via the second output line O7 and the data line D3.

Then, the scan line G3-Gn are sequentially turned on, and the buses B1-B4 are sequentially enabled and disabled in accordance with the above-mentioned control method. That is, when the odd numbers (G1, G3, and so on) of the scan lines are turned on, the buses B2 and B4 are enabled. When the even numbers (G2, G4, and so on) of the scan lines are turned on, the buses B1 and B3 are enabled. The driving polarities of the pixel units 16 in the frame 2 are shown in FIG. 9.

In summary, in the odd numbers of the frames, when the odd numbers of the scan lines are turned on, the first and the third of the buses are sequentially enabled. When the even numbers of the scan lines are turned on, the second and the fourth of the buses are sequentially enabled. In the even numbers of the frames, when the odd numbers of the scan lines are turned on, the second and the fourth of the buses are sequentially enabled. When the even numbers of the scan lines are turned on, the first and the third of the buses are sequentially enabled.

As shown in FIG. 10, effect similar to a 4-dot inversion mode is produced after the driving polarities of the pixel units 16 in the frame 1 (FIG. 8) and the driving polarities of the pixel units 16 in frame 2 (FIG. 9) are added. As a result, the flicker problem and the crosstalk problem in the prior art can be effectively improved.

The liquid crystal display device of the present invention can solve the flicker problem and the crosstalk problem in the prior art. Furthermore, comparing with the prior art in which a dot inversion mode is implemented, the present invention has the advantage of consuming less power.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structures.

What is claimed is:

1. A liquid crystal display device, comprising:

a liquid crystal panel;

at least one source driving unit disposed on the liquid crystal panel and comprising at least one first fan-out line and at least one second fan-out line which are disposed alternately, wherein the at least one first fan-out line is configured to output a first polarity signal, and the second fan-out line is configured to output a second polarity signal;

at least one demultiplexer disposed on the liquid crystal panel and electrically coupled to the first fan-out line and the second fan-out line, the demultiplexer comprising a plurality of buses, a plurality of first output lines, and a plurality of second output lines, the first output lines and the second output lines alternately disposed, each of the buses electrically coupled to one of the first output lines and one of the second output lines; and a plurality of pixel units, each of the pixel units comprising four sub-pixels, in the four sub-pixels of each of the pixel units in an N column, a first and a fourth of the sub-pixels respectively and electrically coupled to a first and a fourth of the first output lines, and a second and a third of the sub-pixels respectively and electrically coupled to a second and a third of the second output lines, in the four sub-pixels of each of the pixel units in an N+1 column, a first and a fourth of the sub-pixels respectively and electrically coupled to a first and a fourth of the second output lines, a second and a third of the sub-pixels respectively and electrically coupled to a second and a third of the first output lines, and N is an odd number greater than or equal to 1, wherein frames are made in sets of four, the first polarity signal has the same polarity in a first and fourth frames in each of the sets, and the first polarity signal has the same polarity in a second and a third frames in each of the sets.

2. The liquid crystal display device of claim 1, wherein the first polarity signal and the second polarity signal have opposite polarities.

3. The liquid crystal display device of claim 1, wherein the frames are made in sets of four, the second polarity signal has the same polarity in the first and fourth frames in each of the sets, and the second polarity signal has the same polarity in the second and third frames in each of the sets.

4. The liquid crystal display device of claim 1, wherein each of the buses is utilized for controlling the first polarity signal and the second polarity signal to be outputted to one of the first output lines and one of the second output lines.

5. The liquid crystal display device of claim 1, further comprising a plurality of scan lines and four buses, wherein the scan lines are electrically coupled to the pixel units, in odd numbers of frames, when odd numbers of the scan lines are turned on, a first and a second of the buses are sequentially enabled, when even numbers of the scan lines are turned on, a third and a fourth of the buses are sequentially enabled.

6. The liquid crystal display device of claim 5, wherein in even numbers of the frames, when the odd numbers of the scan lines are turned on, the third and the fourth of the buses are sequentially enabled, when the even numbers of the scan lines are turned on, the first and the second of the buses are sequentially enabled.

7. The liquid crystal display device of claim 1, further comprising a plurality of scan lines and four buses, wherein the scan lines are electrically coupled to the pixel units, in odd numbers of frames, when odd numbers of the scan lines are turned on, a first and a third of the buses are sequentially enabled, when even numbers of the scan lines are turned on, a second and a fourth of the buses are sequentially enabled.

8. The liquid crystal display device of claim 7, wherein in even numbers of the frames, when the odd numbers of the scan lines are turned on, the second and the fourth of the buses are sequentially enabled, when the even numbers of the scan lines are turned on, the first and the third of the buses are sequentially enabled.

9. The liquid crystal display device of claim 1, wherein the four sub-pixels comprise a red sub-pixel, a green sub-pixel, a blue sub-pixel, and a white sub-pixel.

10. A liquid crystal display device, comprising:

a liquid crystal panel;

at least one source driving unit disposed on the liquid crystal panel and comprising at least one first fan-out line and at least one second fan-out line, wherein the at least one first fan-out line is configured to output a first polarity signal, and the second fan-out line is configured to output a second polarity signal;

at least one demultiplexer disposed on the liquid crystal panel and electrically coupled to the first fan-out line and the second fan-out line, the demultiplexer comprising a plurality of buses, a plurality of first output lines, and a plurality of second output lines, each of the buses electrically coupled to one of the first output lines and one of the second output lines; and a plurality of pixel units, each of the pixel units comprising four sub-pixels, in the four sub-pixels of each of the pixel units in an N column, a first and a fourth of the sub-pixels respectively and electrically coupled to a first and a fourth of the first output lines, and a second and a third of the sub-pixels respectively and electrically coupled to a second and a third of the second output lines, in the four sub-pixels of each of the pixel units in an N+1 column, a first and a fourth of the sub-pixels respectively and electrically coupled to a first and a fourth of the second output lines, a second and a third of the sub-pixels respectively and electrically coupled to a second and a third of the first output lines, and N is an odd number greater than or equal to 1, wherein frames are made in sets of four, the first polarity signal has the same polarity in a first and fourth frames in each of the sets, and the first polarity signal has the same polarity in a second and a third frames in each of the sets.

11. The liquid crystal display device of claim 10, wherein the first polarity signal and the second polarity signal have opposite polarities.

12. The liquid crystal display device of claim 10, wherein the frames are made in sets of four, the second polarity signal has the same polarity in the first and fourth frames in each of the sets, and the second polarity signal has the same polarity in the second and third frames in each of the sets.

13. The liquid crystal display device of claim 10, wherein each of the buses is utilized for controlling the first polarity signal and the second polarity signal to be outputted to one of the first output lines and one of the second output lines.

14. The liquid crystal display device of claim 10, further comprising a plurality of scan lines and four buses, wherein the scan lines are electrically coupled to the pixel units, in odd numbers of frames, when odd numbers of the scan lines are turned on, a first and a second of the buses are sequentially enabled, when even numbers of the scan lines are turned on, a third and a fourth of the buses are sequentially enabled.

15. The liquid crystal display device of claim 14, wherein in even numbers of the frames, when the odd numbers of the scan lines are turned on, the third and the fourth of the buses are sequentially enabled, when the even numbers of the scan lines are turned on, the first and the second of the buses are sequentially enabled.

16. The liquid crystal display device of claim 10, further comprising a plurality of scan lines and four buses, wherein the scan lines are electrically coupled to the pixel units, in odd numbers of frames, when odd numbers of the scan lines are turned on, a first and a third of the buses are sequentially enabled, when even numbers of the scan lines are turned on, a second and a fourth of the buses are sequentially enabled.

17. The liquid crystal display device of claim 16, wherein in even numbers of the frames, when the odd numbers of the scan lines are turned on, the second and the fourth of the buses are sequentially enabled, when the even numbers of the scan lines are turned on, the first and the third of the buses are sequentially enabled.

18. The liquid crystal display device of claim 10, wherein the four sub-pixels comprise a red sub-pixel, a green sub-pixel, a blue sub-pixel, and a white sub-pixel.

* * * * *